United States Patent [19]

Albertson

[11] 4,062,076

[45] Dec. 13, 1977

[54] READER'S BLANKET

[76] Inventor: Diane C. Albertson, 5138 Vera Lane, San Jose, Calif. 95111

[21] Appl. No.: 675,828

[22] Filed: Apr. 12, 1976

[51] Int. Cl.[2] ..... A47B 23/00

[52] U.S. Cl. ..... 5/334 R; 5/335; 2/69.5

[58] Field of Search ..... 2/69, 69.5; D6/268; 5/334 R, 334 C, 335

[56] References Cited

U.S. PATENT DOCUMENTS

| | | | |
|---|---|---|---|
| D. 25,134 | 2/1896 | Barlow | D6/268 |
| D. 190,621 | 6/1961 | Foster | D6/268 |
| 849,624 | 4/1907 | Kinder | 2/69 |
| 1,247,035 | 11/1917 | Tilden | 2/69 |
| 2,624,048 | 1/1953 | Kovary | 2/69.5 |
| 2,702,385 | 2/1955 | Goldberg | 2/69.5 |
| 2,722,694 | 11/1955 | Bryant | 5/334 R |

FOREIGN PATENT DOCUMENTS

| | | | |
|---|---|---|---|
| 62,965 | 11/1912 | Switzerland | 5/334 R |

*Primary Examiner*—Casmir A. Nunberg
*Attorney, Agent, or Firm*—Brown & Martin

[57] ABSTRACT

A blanket includes one edge defining a head end of the blanket and a pair of spaced apart openings adjacent the head end for receiving the hands and a portion of the arms extending therethrough of a person disposed under the blanket. The openings are spaced from the edge sufficient at least to permit the neck and shoulders of the person to be covered by the blanket when the hands are in a position through the opening for holding a book for reading. The openings are preferably in the form of slots which are self-closing and may cooperate with a design on the blanket to define the edge of the eyelids of an object such as the face of a person, character or an animal formed on the face of the blanket.

2 Claims, 5 Drawing Figures

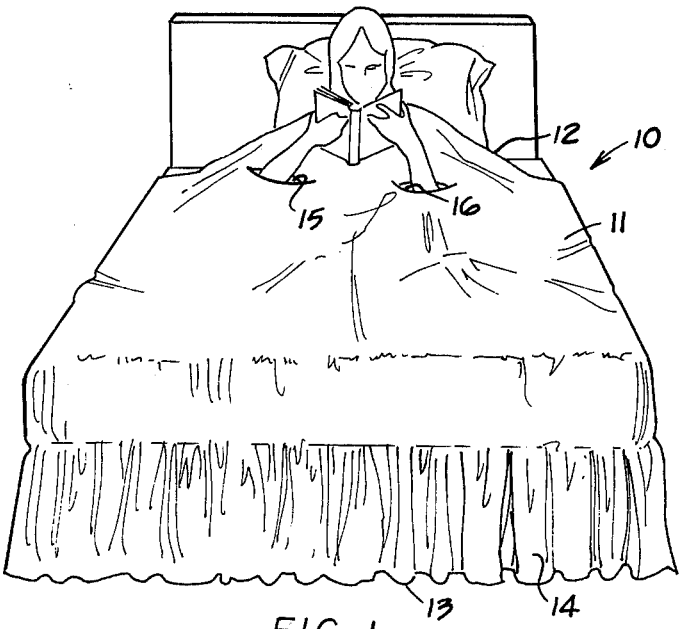
FIG. 1.
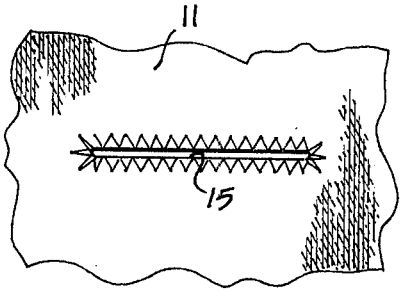
FIG. 2.
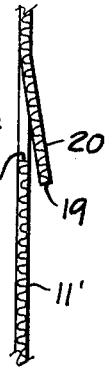
FIG. 4.
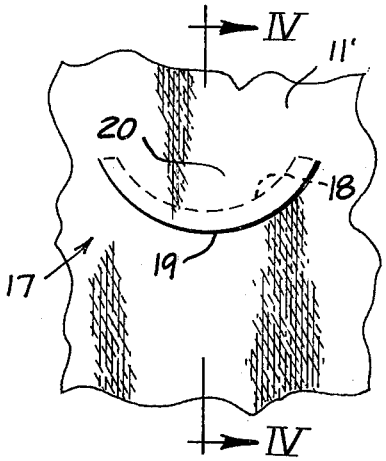
FIG. 3.
FIG. 5.
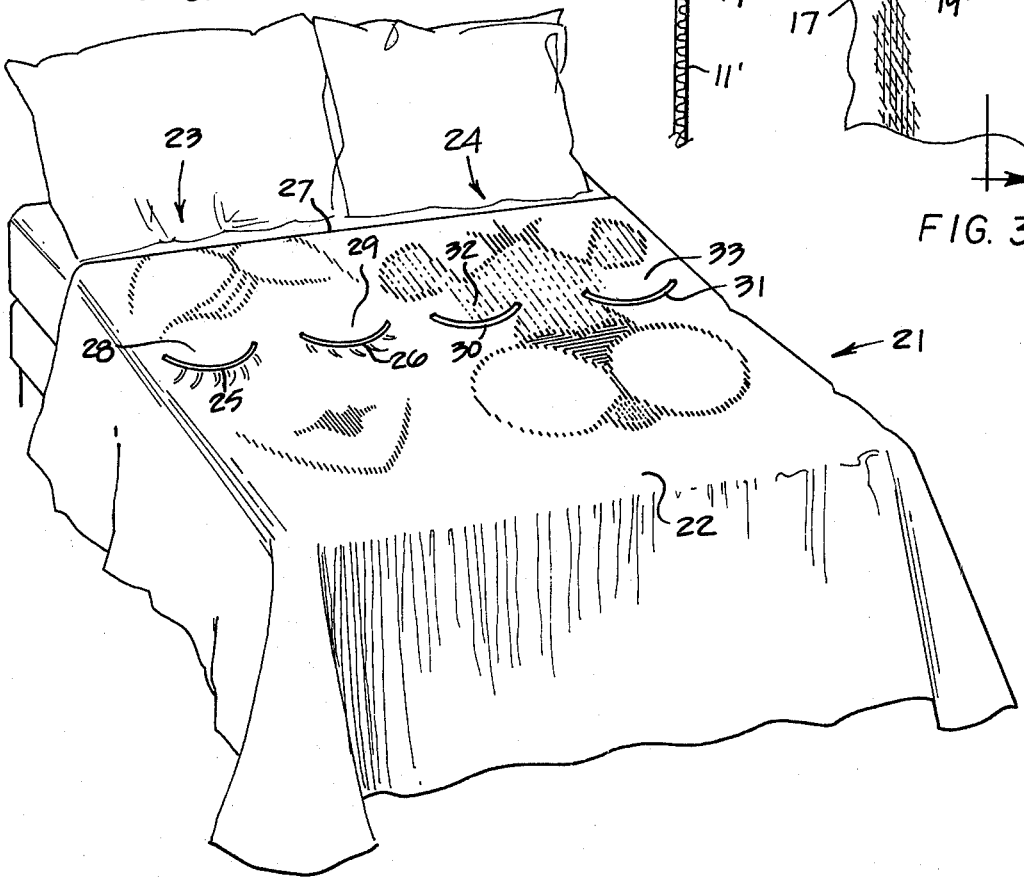

READER'S BLANKET

BACKGROUND OF THE INVENTION

The present invention relates to bedclothes generally and pertains particularly to a specially designed bedcovering to permit a person to read in comfort while disposed at least partially under the covering.

It is common practice for many people to sit up and read in bed for a period of time after retiring and before going to sleep for the night. Also, people who are bedridden for extended periods of time often read a great deal to pass the time.

Such reading in bed is no problem when the room is adequately heated and in warmer climates. However, when the room is not adequately heated conventional bedcovers interfere with a persons holding a book in a reading position while comfortably covered under the bedcovering.

The applicant's solution to this problem contemplates the provision of openings for the hands to be extended for holding a book during reading. While the prior art does not appear to have recognized this problem or provided any approach to the solution of this problem, U.S. Pat. No. 2,722,694, issued Nov. 8, 1955 to Bryant is of general interest relative thereto.

The provision of openings or slits in bedcoverings can become unsightly or disrupt an attractive design or pattern on such bedcoverings. For this reason, applicant contemplates the incorporation of these openings into decorative designs placed upon such bedcoverings. While again this problem does not appear to have been contemplated or any solution therefor contemplated within the prior art, the following U.S. Patents are of interest:

U.S. Pat. No. 3,613,133, issued Oct. 19, 1971, to Isola, et al.; U.S. Des. 160,595, issued Oct. 24, 1959 to Gunnill; U.S. Des. 160,596, issued Oct. 24, 1950 to Gunnill and U.S. Des. 190,621, issued June 13, 1961 to Foster.

The applicant has devised means for overcoming the problems of the prior art as will be discussed hereinbelow.

SUMMARY OF THE INVENTION

It is the primary object of the present invention to overcome the above problems of the prior art.

Another object of the present invention is to provide a bedcovering that permits a person to be comfortably covered while holding a book for reading.

A further object of the present invention is to provide a blanket or the like having one or more openings so positioned to permit a person to hold an object externally of the blanket while being covered thereby.

In accordance with the primary aspect of the present invention, a bedcovering such as a blanket or the like is provided with one or more openings so disposed as to permit the hand of an individual covered by said bedcovering to extend therethrough for holding an object externally of the covering.

BRIEF DESCRIPTION OF THE DRAWINGS

The above and other objects and advantages of the present invention will become apparent from the following description when read in conjunction with the drawings wherein:

FIG. 1 is a front view of an embodiment of the present invention;

FIG. 2 is a detailed view of a portion of the embodiment of FIG. 1;

FIG. 3 is a detailed view of an alternate construction of the element of FIG. 2;

FIG. 4 is a sectional view generally along lines IV—IV of FIG. 3; and,

FIG. 5 is a perspective view of an alternate embodiment of the present invention.

DETAILED DESCRIPTION OF THE PREFERRED EMBODIMENT

With reference now to the drawing and particularly FIG. 1, there is illustrated a bedcovering indicated generally by the numeral 10 incorporating the present invention shown in use on a bed by an individual reading a book. The bedcovering 10 comprises generally a main body portion 11 having the usual configuration and constructed of a suitable material and constructed to have an upper edge or portion 12 defining the head end thereof and a lower edge 13 defining the foot thereof. The covering is designed to be placed on a bed in a manner that the head end 12 is at the head of the bed as illustrated and the foot edge 13 is at the foot end of the bed as illustrated. Although the covering 10 is illustrated as having a generally rectangular configuration, it need not be so shaped. For example, it may have a round or oval configuration as some beds are designed.

The covering 10 may also be a blanket, a sheet, a quilt, a comforter or what is commonly called a bedspread. In many instances, blankets are normally of a plain design and are normally covered when the bed is not in use by what is typically termed a bedspread for ornamental purposes. Frequently, however, the blanket or quilt may serve both functions.

It is also apparent that what is normally referred to as the sheet could also serve this function.

For the purposes of the clarity of the description, and for the purposes of more readily facilitating and understanding of the invention, the following terms which are used throughout the specification and claims are defined as follows:

Printed - any manner of providing means on a bedclothes element defining an article, person, character, animal etc. as appearing on or in the plane of the element, including weaving, sewing, embroidering or otherwise embellishing the article, person, character, etc., defining means on the bedclothes, or by printing or stamping as by an engraved plate or lithograph, silkscreen, or otherwise providing an impression on the bedclothes element through the use of a dye transferred by pressure from a plate or the like.

Bed — any article for one or more persons to sleep on or take rest in or anything or place for sleeping, resting or reclining including mattresses, couches, etc., and including a head section wherein the person sleeping or reclining, resting or the like usually positions his head, shoulders and other portions of the upper part of his anatomy, and a foot section wherein the person resting, reclining, etc., usually positions his feet, legs or other portions of the lower part of his anatomy.

Pictoral illustration — an illustration wherein one or more persons, characters, animals, scenes, etc., appear on an associated bedclothes element.

Bedclothes element — any type and size of sheets, pillowcases, blankets, quilts, bedspreads, etc., either fitted or non-fitted or of any configuration for a particular bed as defined above.

Bedspread — any article of bedclothing which may be used as the outer covering to cover a bed and/or any associated bedclothes provided thereon.

The bedcover 10 as mentioned may be either the normally outer covering of the bed or one of the inner covering elements and may, as illustrated, include ruffling or the like 14 or any other form of ornamentation. The illustrated embodiment 10 is designed such as for a single bed and for a single individual normally located at the center of the bed and includes first and second openings 15 and 16 through which the arms of the individual protrude from beneath for a glass of water or any other object while the upper portion of his body from the arms up at least to the neck and upper shoulders are covered with the upper portion of the cover extending up to the edge 12. Thus, the openings 15 and 16 are spaced adjacent to the head end or edge 12 of the bedcover element but sufficiently away from the edge 12 that sufficient material exists between the openings 15 and 16 and the edge 12 to cover the upper portion of the torso of a person up to the neck and over the shoulders.

As will be appreciated from FIG. 1, the openings 15 and 16 for a covering of a single bed will be spaced to either side of a center line bisecting the covering running from the foot edge 13 to the head edge 12 of the covering. These slots are spaced laterally along a line that would run approximately parallel to the upper edge 12.

The openings 15 and 16 may be of any suitable configuration but one preferred embodiment as shown in FIG. 2 is that of a slot or slit extending laterally such that this configuration would extend parallel to the upper edge 12. The straight slot configuration 15 would act substantially like a buttonhole and would open sufficiently to permit the arm or hand to be extended therethrough but would close by tension in the material upon removal of the hand and arm. The slot may be suitable reinforced as shown or in any other suitable manner.

In FIG. 3 is illustrated an alternate embodiment of the slot wherein the main body portion 11 of a covering is formed with a slot indicated generally at 17. The slot is formed in the body portion at 11' and defines a first edge 18 of an arcuate configuration and a second edge 17 of a similar configuration. The second edge 19 defines an edge of a flap 20 which overlaps the edge 18 to normally close the opening defined thereby. Although the flap and edge portion 19 overlaps the portion or edge 18, it will be appreciated that the flap 20 can be so constructed that such overlap does not occur but that the edge 19 can fit within and closely adjacent to the edge 18 and remain normally closed as in the embodiment of FIG. 2.

In FIG. 5 is illustrated a further embodiment of the invention wherein a bedcovering designated generally by the numeral 21 which includes a main central body portion 22 on which is suitably printed an illustration which depicts the face of a person, character, or animal which cooperates with the openings in the cover to camouflage or provide suitable ornamentation therewith. The covering 21 is illustrated as being for a double bed and illustrates a human character or face illustrated generally at 23 and an animal face or character designated generally by the numeral 24. In this embodiment, slots or slits 25 and 26 are of an arcuate configuration with the center of the arc disposed toward an edge 27 defining the head end of the cover. These arcuate slots 25 and 26 define or form flaps 28 and 29 which form the eyelids of the face of the human character or the like. The face is depicted with the eyes closed when the flaps 28 and 29 are similarly closed.

For illustrative purposes, an animal character or face is illustrated at 24 on the right hand portion of the cover 21 and likewise includes slits 30 and 31 defining flaps 32 and 33 which also define eyelids of the animal character. As in the previous embodiment, the eyes are depicted as closed when the flaps are closed. This arrangement of the slots and flaps in conjunction with the face depicted thereon serves to camouflage or hide the slits themselves.

Thus, it will be appreciated that either one or both of the faces depicted on the face of the covering can be either human or animal and likewise any combination thereof. It will also be appreciated from these embodiments that the cover can incorporate either a single slot, a single pair of slots or separate pairs of slots for either a single or a double bed.

While the invention has been described by means of a single embodiment, numerous changes and modifications can be made therein without departing from the spririt and scope of the invention as defined in the appended claims.

What is claimed is:

1. A non-restraining bedclothes cover adapted to be loosely draped over a bed for at least partially covering a person disposed thereon;

said cover having a generally rectangular configuration including one edge defining a head end thereof for placing at the head end of a bed, a pair of spaced apart arcuate slits extending through said cover adjacent said head end for receiving the hands and a portion of the arms extending therethrough of a person disposed thereunder and, said openings spaced from said edge sufficient at least to provide sufficient blanket therebetween for extending up to and covering the neck and shoulders by said person to be covered by said bedclothes cover when the person is in a sitting position and the hands are in a position for holding a book for reading, said arcuate slits being defined by first and second arcuate edges, one of said edges overlapping the other of said edges defining a flap for closing said slits, and means depicting a pictoral illustration of the head of at least one object taken from the group of persons, characters, and animals and said flaps define the eyelids of said one object.

2. The bedclothes covers of claim 1 wherein said slits are formed on one side of a center-line of said bedclothes cover, and said bedclothes cover includes a second pair of openings correspondingly positioned on the other side of said centerline.

* * * * *